US011673154B2

(12) United States Patent
Cheng

(10) Patent No.: US 11,673,154 B2
(45) Date of Patent: Jun. 13, 2023

(54) OSCILLATING RANGE ADJUSTING MODULE FOR USE IN SPRINKLER

(71) Applicant: YUAN-MEI CORP., Changhua County (TW)

(72) Inventor: Chi-Han Cheng, Changhua County (TW)

(73) Assignee: YUAN-MEI CORP., Changhua County (TW)

( * ) Notice: Subject to any disclaimer, the term of this patent is extended or adjusted under 35 U.S.C. 154(b) by 425 days.

(21) Appl. No.: 16/801,089

(22) Filed: Feb. 25, 2020

(65) Prior Publication Data

US 2021/0260610 A1 Aug. 26, 2021

(51) Int. Cl.
*B05B 3/14* (2006.01)
*B05B 12/00* (2018.01)

(52) U.S. Cl.
CPC ..... *B05B 12/002* (2013.01); *B05B 3/14* (2013.01)

(58) Field of Classification Search
CPC ..... B05B 12/002; B05B 3/14
USPC ..... 239/574
See application file for complete search history.

(56) References Cited

U.S. PATENT DOCUMENTS 1,112,271 A * 9/1914 Demuth ..... B05B 3/0422 239/242
3,430,860 A * 3/1969 Ho ..... B05B 3/044 239/242
4,568,023 A * 2/1986 Hayes ..... B05B 3/044 239/242
4,919,337 A * 4/1990 Van Leeuwen ..... B05B 3/0431 239/206
7,086,609 B2 * 8/2006 Wang ..... B05B 3/0436 239/242
7,226,000 B2 * 6/2007 Huang ..... B05B 3/044 74/577 M
9,764,340 B2 * 9/2017 Zhu ..... B05B 3/044

* cited by examiner

*Primary Examiner* — Chee-Chong Lee
(74) *Attorney, Agent, or Firm* — Che-Yang Chen; Law Office of Michael Chen

(57) ABSTRACT

An oscillating range adjusting module with modular design for being mounted into a sprinkler is revealed. The oscillating range adjusting module which includes a first adjusting unit and a second adjusting unit is located between a water-in control module and an oscillation driving module. During assembly, the first adjusting unit is fitted on an inlet tube of a water-in control module. After an O-ring being connected to the first adjusting unit, the second adjusting unit is mounted on the inlet tube and connected to the first adjusting unit by at least one fastener of the second adjusting unit engaged with at least one connection surface of the first adjusting unit. Lastly a water inlet of the oscillation driving module is connected to the second adjusting unit. Thereby, a modular assembly of the oscillating range adjusting module between the oscillation driving module and the water-in control module is achieved.

18 Claims, 11 Drawing Sheets

OSCILLATING RANGE ADJUSTING MODULE FOR USE IN SPRINKLER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a sprinkler for garden irrigation, and more particularly to an oscillating range adjusting module used in a sprinkler for garden irrigation.

Description of Related Arts

A sprinkler is an essential tool for horticultural irrigation, used for the widespread spraying of water to trees, flowers and grass in a nursery garden. The most common sprinklers for garden irrigation available now include impact sprinklers, sprinklers, rotary sprinklers and swing arm sprinklers.

Referring to U.S. Pat. No. 9,764,340, a sprinkler is revealed. A perspective view of a conventional sprinkler is shown in FIG. 1. As shown in FIG. 1, a sprinkler 100' mainly includes an input port 102' connected between a hose 104', which extends to a water source, and a drive motor 106' that is configured for oscillating movement of a nozzle 108'. The distance in the arc of travel for the nozzle 108' is set by an oscillation range limiting module shown in FIG. 2 and composed of a first limit switch 180' and a second limit switch 182'. As shown in FIG. 2, the first limit switch 180' is a first cylindrical body which includes a first spacer 184' on the peripheral sides thereof and a first stop 186' at the end of a first arcuate path 188'. The first arcuate path 188' is on the surface of the first cylindrical body. Similarly, the second limit switch 182' is a second cylindrical body which includes a second spacer 190' on the peripheral sides thereof and a second stop 192' at the end of a second arcuate path 190'. The second arcuate path 194' is on the bottom surface of the second cylindrical body.

While assembling the above oscillation range limiting module into the sprinkler 100', an inlet tube of a cylinder housing 110' as shown in FIG. 2 of U.S. Pat. No. 9,764,340 B2 is connected to a central opening of the first limit switch 180' (the first cylindrical body) and a central opening of the second limit switch 182' (the second cylindrical body) through riveting. Thereby the first limit switch 180', the second limit switch 182', and the inlet tube are assembled simultaneously in this way. However, the sprinklers available now have a modular design which allows easy and direct assembly of any two of the adjacent modules without using any other assembling processes such as riveting. Since the oscillation range limiting module and the inlet tube of the cylinder housing are connected through riveting, the sprinkler with such design is not suitable for the modular assembly line.

Thus, there is room for improvement and there is a need to provide a novel design of an oscillating range limiting module of a sprinkler, which is able to be assembled with a water inlet tube of a water inlet module without tools.

SUMMARY OF THE PRESENT INVENTION

Therefore it is a primary object of the present invention to provide an oscillating range adjusting module with modular design, which is used in a sprinkler and able to be mounted between a water-in control module and an oscillation driving module in a tool-less manner.

In order to achieve the above object, an oscillating range adjusting module, configured to be used in a sprinkler and connected between a water-in control module and an oscillation driving module according to the present invention, includes a first adjusting unit and a second adjusting unit. The first adjusting unit comprises a first circular plate, a first circular side wall disposed on a top surface of the first circular plate, a hollow connecting cylinder which is formed on a center of the first circular plate and used for being connected to an inlet tube of the water-in control module, and a first curved slot which is disposed on the first circular plate and located beside the hollow connecting cylinder, close to the first circular side wall. The first adjusting unit further has at least one connection surface formed on an edge at the bottom of the hollow connecting cylinder. The second adjusting unit comprises a second circular plate having a top surface connected to a bottom surface of the first circular plate, a second circular side wall formed on a bottom surface of the second circular plate, an assembly hole which is formed on a center of the second circular plate and connected to the bottom of the hollow connecting cylinder, and a second curved slot which is disposed on the second circular plate and located beside the assembly hole, close to the second circular side wall. The assembly hole of the second adjusting unit is used for connection to a water inlet of the oscillation driving module. The second adjusting unit further includes at least one snapping member which is formed on the top surface of the second circular plate and used for being engaged with the connection surface of the first adjusting unit so as to connect the first adjusting unit and the second adjusting unit.

The oscillating range adjusting module further includes an O-ring clipped between the bottom of the hollow connecting cylinder and the edge of the assembly hole.

During assembly, the first adjusting unit is mounted on an inlet tube of the water-in control module and then the O-ring is connected to the first adjusting unit. Next, the second adjusting unit is fitted on the inlet tube and connected to the first adjusting unit by at least one snapping member of the second adjusting unit being engaged with at least one connection surface of the first adjusting unit. Then, a water inlet of the oscillation driving module is connected to the second adjusting unit. Thereby, the modular assembly of the oscillating range adjusting module between the oscillation driving module and the water-in control module is achieved.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn structure, features, functions and advantages of an oscillating range adjusting module of the present invention more clearly, please refer to the following embodiments with reference to the related drawings.

Figure 1:
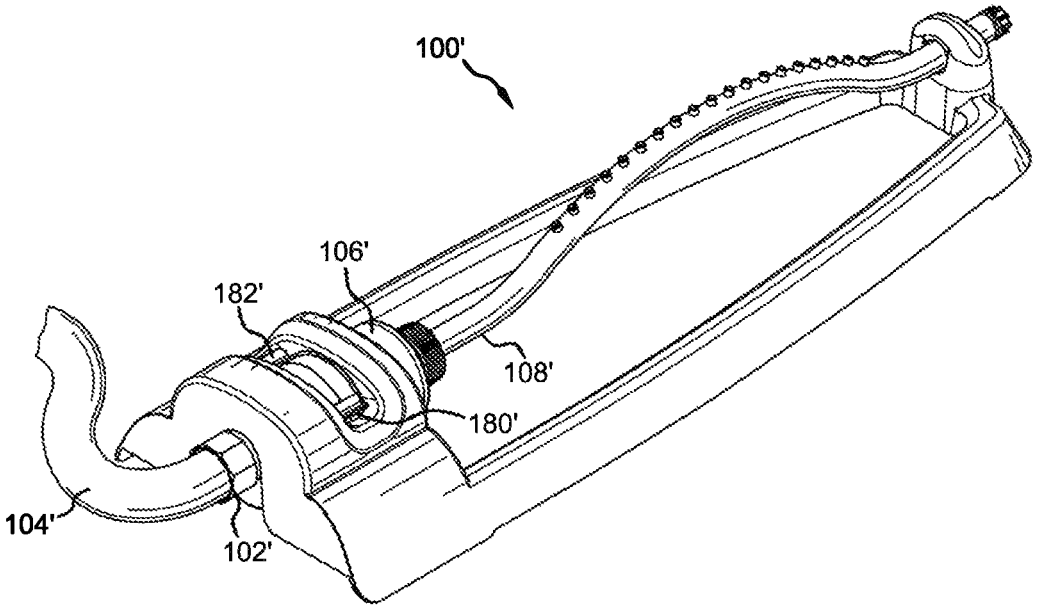
FIG. 1 (Prior Art)
FIG. 1 is a perspective view of a conventional sprinkler.
Figure 2:
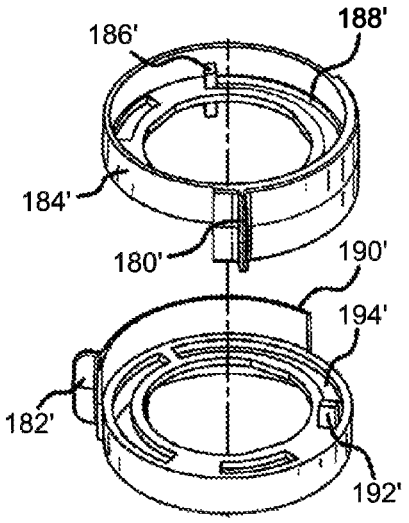
FIG. 2 (Prior Art)
FIG. 2 is an explosive view of an oscillation range limiting module of a conventional sprinkler.
Figure 3:
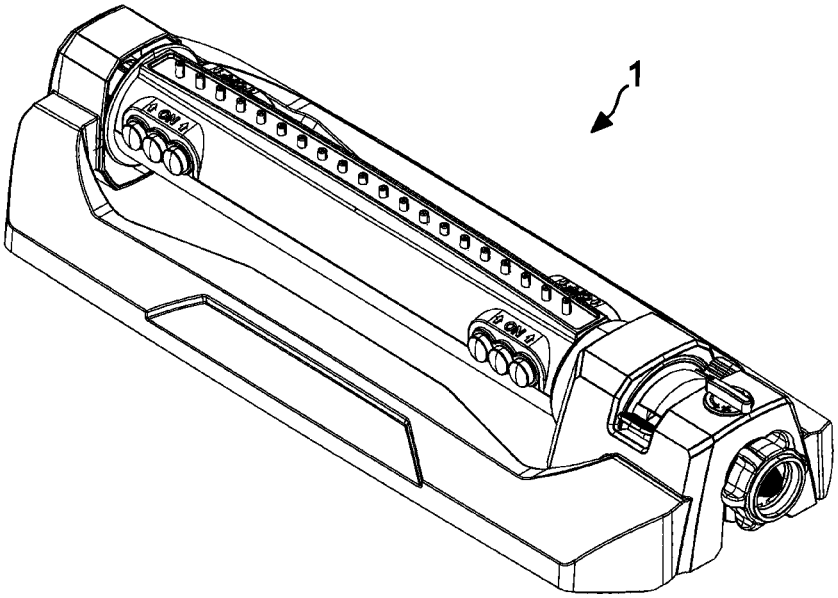
FIG. 3 is a perspective view of a sprinkler illustrating an embodiment of an oscillating range adjusting module according to the present invention.
Figure 4:
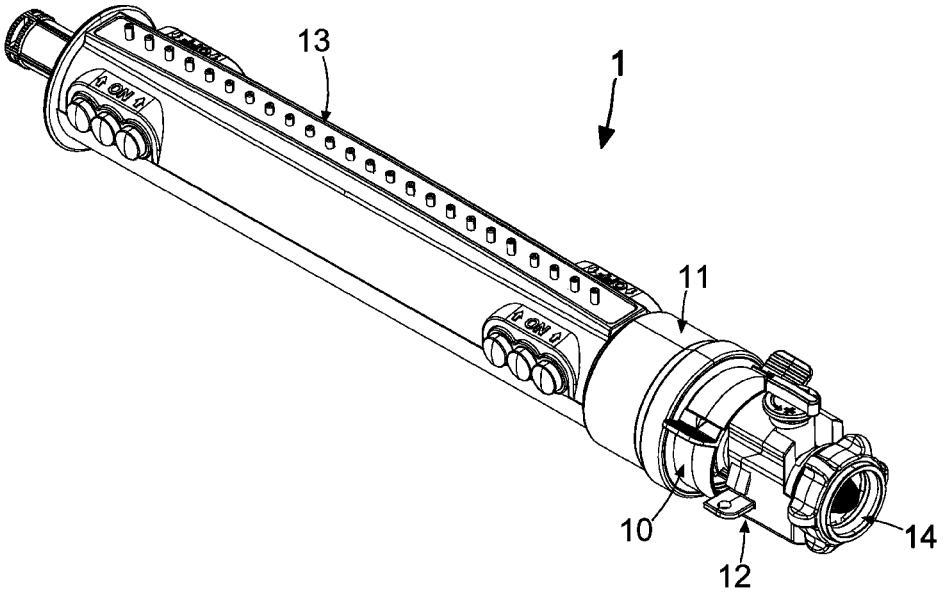
FIG. 4 is another perspective view of a sprinkler illustrating an embodiment of an oscillating range adjusting module according to the present invention.
Figure 5:
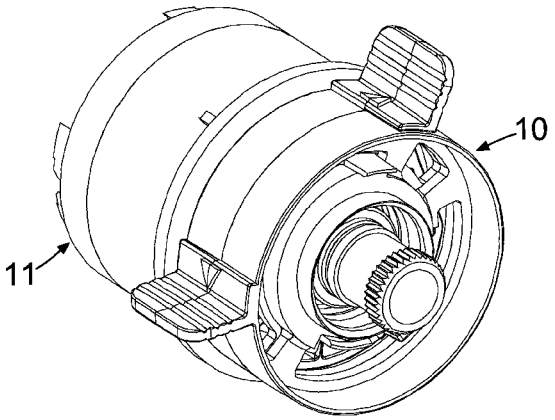
FIG. 5 is a perspective view of an assembly of an oscillation driving module illustrating an embodiment of an oscillating range adjusting module according to the present invention.

Referring to FIG. 3, a perspective view of a sprinkler having an oscillating range adjusting module of the present invention is revealed. FIG. 4 illustrates another perspective view of a sprinkler having an oscillating range adjusting module of the present invention. Compared FIG. 3 with the FIG. 4, the sprinkler 1 as shown in FIG. 4 doesn't include a fixing base. Referring to FIG. 3 and FIG. 4, the sprinkler 1 mainly includes a hose connecting module 14, a water-in control module 12, an oscillating range adjusting module 10 of the present invention, an oscillation driving module 11, and a spraying nozzle module 13. The oscillating range adjusting module 10 of the present invention is connected between the oscillation driving module 11 and the water-in control module 12.

Referring to FIG. 5, FIG. 6, FIG. 7, and FIG. 8, the oscillating range adjusting module 10 of the present invention mainly comprises a first adjusting unit 101, a second adjusting unit 102 and an O-ring 103. The first adjusting unit 101 comprises a first circular plate 1011, a first circular side wall 1012, and a hollow connecting cylinder 1013, and has a first curved slot 1015 and a third curved slot 1014. The first circular side wall 1012 is formed on a top surface of the first circular plate 1011. It should be noted that the hollow connecting cylinder 1013 is formed on a center of the first circular plate 1011 and used for connection with an inlet tube of the water-in control module 12. A mounting groove 101E is formed at an inner surface of the hollow connecting cylinder 1013 for mounting an O-ring therein.

Figure 7:
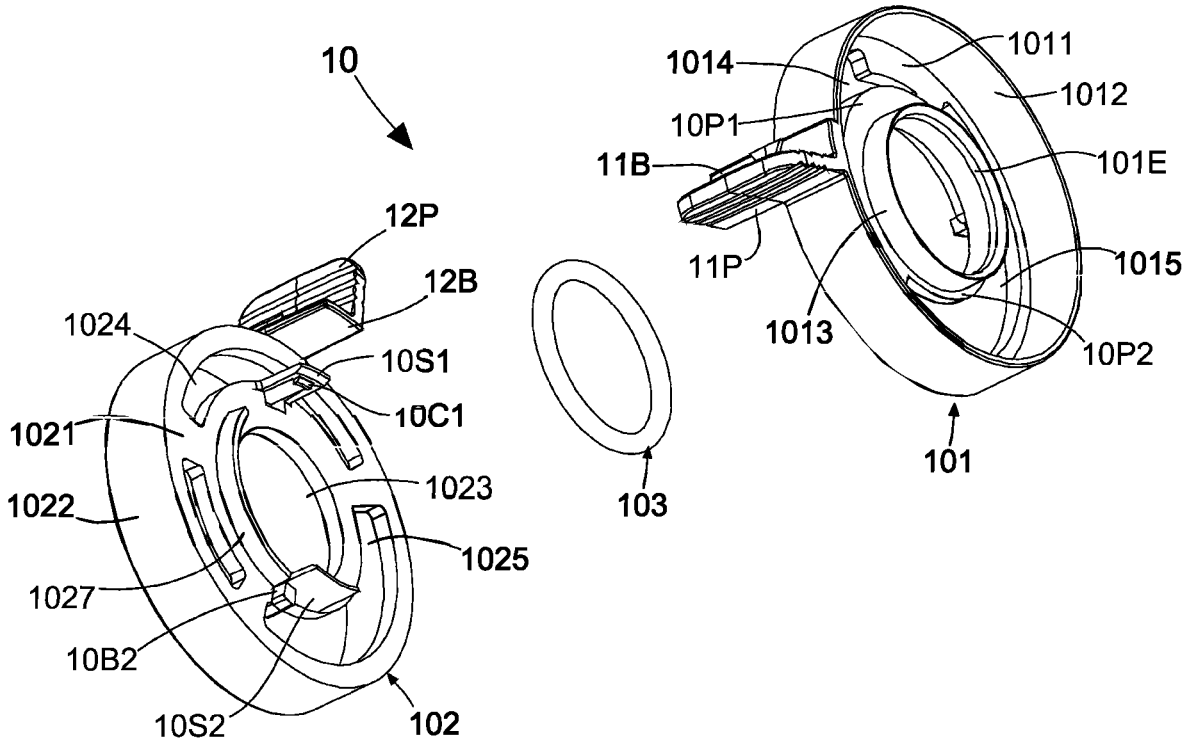
FIG. 7 illustrates an explosive view of an embodiment of an oscillating range adjusting module according to the present invention.
Figure 8:
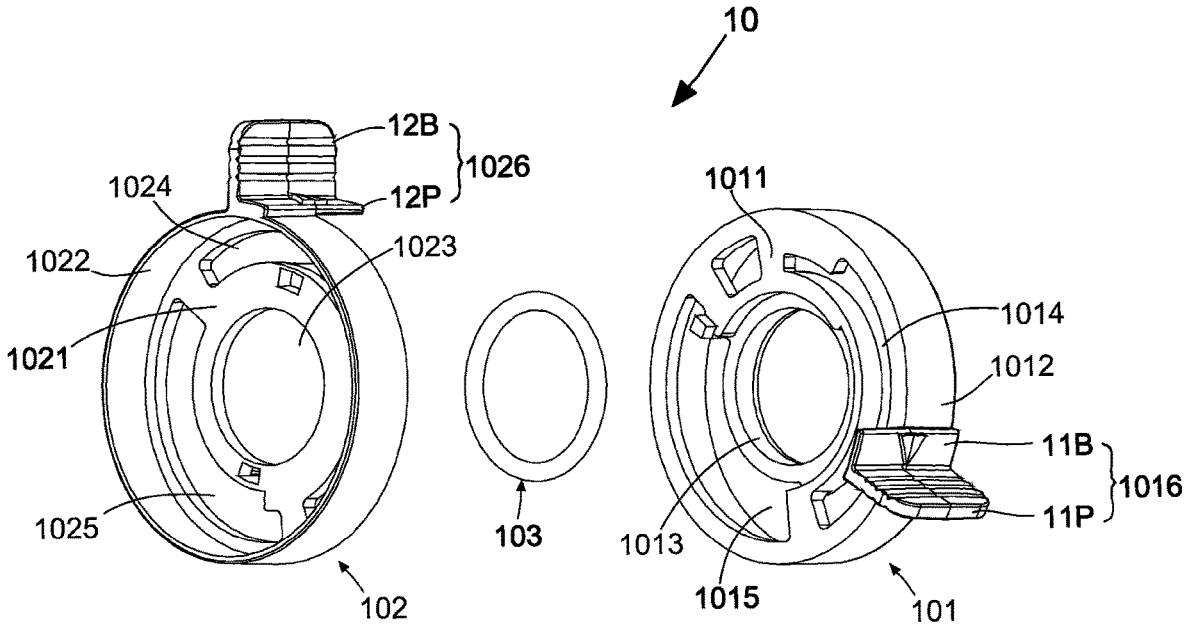
FIG. 8 illustrates another explosive view of an embodiment of an oscillating range adjusting module according to the present invention.
Figure 9:
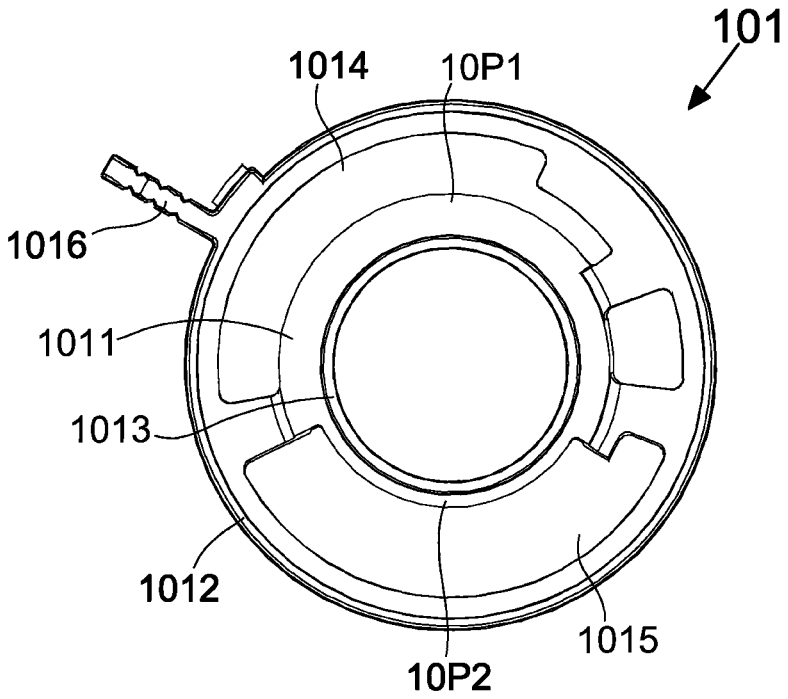
FIG. 9 is a front view of a first adjusting unit illustrating an embodiment of an oscillating range adjusting module according to the present invention.
Figure 11:
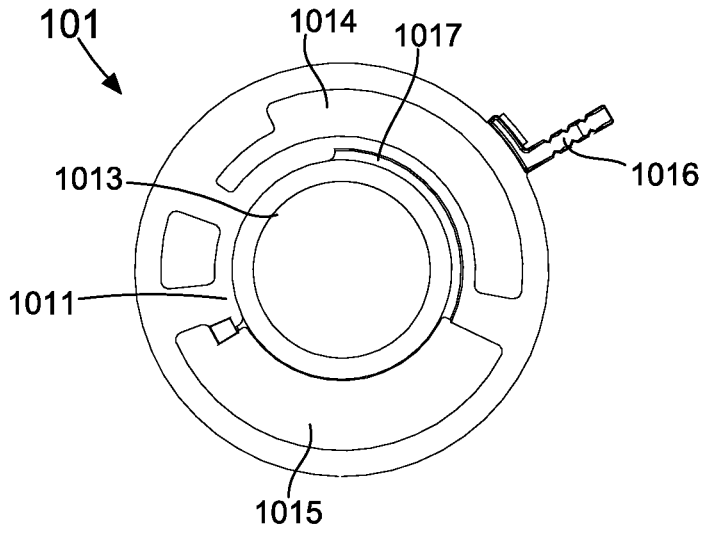
FIG. 11 is a rear view of a first adjusting unit illustrating an embodiment of an oscillating range adjusting module according to the present invention.

As shown in FIGS. 7 and 8, the first curved slot 1015 and the third curved slot 1014 are arranged at the first circular plate 1011. The first curved slot 1015 is located beside the hollow connecting cylinder 1013 and close to the first circular side wall 1012 while the third curved slot 1014 is located beside the hollow connecting cylinder 1013 and close to the first circular side wall 1012. It should be noted that at least one connection surface (10P1/10P2) is disposed on an edge at the bottom of the hollow connecting cylinder 1013. As shown in the figures, a first connection surface 10P1 and a second connection surface 10P2 are formed on an edge at the bottom of the bottom of the hollow connecting cylinder 1013. The first connection surface 10P1 is located between the third curved slot 1014 and the hollow connecting cylinder 1013 while the second connection surface 10P2 is located between the first curved slot 1015 and the hollow connecting cylinder 1013. With reference to FIG. 9, a first pull member 1016 is connected to an outer surface of the first circular side wall 1012 and located beside the hollow connecting cylinder 1013, opposite to the first curved slot 1015. Moreover, a limiting curved groove 1017 is formed on a bottom surface of the first circular plate 1011, as shown in FIG. 11.

Referring to FIG. 7 and FIG. 8, the second adjusting unit 102 comprises a second circular plate 1021 and a second circular side wall 1022, and has an assembly hole 1023, a second curved slot 1025 and a fourth curved slot 1024. The second circular side wall 1022 is formed on a bottom surface of the second circular plate 1021. It should be noted that the surface of the first circular plate 1011/second circular plate 1021 facing the water-in control module 12 is defined as the top surface while the surface of the first circular plate 1011/second circular plate 1021 facing the oscillation driving module 11 is defined as the bottom surface. The top surface of the second circular plate 1021 is connected to the bottom surface of the first circular plate 1011. The assembly hole 1023 is formed on a center of the second circular plate 1021 and is connected to the bottom of the hollow connecting cylinder 1013 of the first adjusting unit 101. As to the second adjusting unit 102, the assembly hole 1023 thereof is used for connecting to a water inlet of the oscillation driving module 11.

Figure 6:
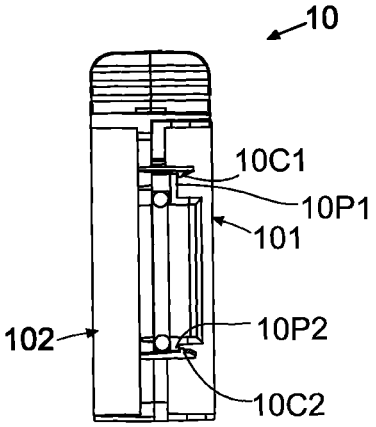
FIG. 6 is a sectional view of an embodiment of an oscillating range adjusting module according to the present invention.

Particularly, the second curved slot 1025 and the fourth curved slot 1024 are disposed on the second circular plate 1021. As shown in FIG. 7 and FIG. 8, the second curved slot 1025 is located beside the assembly hole 1023 and close to the second circular side wall 1022 while the fourth curved slot 1024 is located beside the assembly hole 1023 and close to the second circular side wall 1022. A first snapping member 10C1 and a second snapping member 10C2 are arranged at the top surface of the second circular plate 1021 and respectively engaged with the first connection surface 10P1 and the second connection surface 10P2 when the second adjusting unit 102 is connected to the first adjusting unit 101, as shown in FIG. 6. Moreover, a second pull member 1026 is connected to an outer surface of the second circular side wall 1022 and located beside the assembly hole 1023, opposite to the second curved slot 1025. Particularly, a limiting curved protrusion 1027 is formed on the top surface of the second circular plate 1021 and used for being mounted into the limiting curved groove 1017. Still refer to FIG. 7 and FIG. 8, the first pull member 1016 consists of a first base portion 11B and a first pull portion 11P while the bottom surface of the first base portion 11B is in close contact with the outer surface of the second circular side wall 1022. Similarly, the second pull member 1026 is composed of a second base portion 12B and a second pull portion 12P while the bottom surface of the second base portion 12B is in close contact with the outer surface of the first circular side wall 1012.

When the top surface of the second circular plate 1021 is connected to the bottom surface of the first circular plate 1011, the O-ring 103 is clipped between the bottom of the hollow connecting cylinder 1013 and the edge of the assembly hole 1023. And the limiting curved protrusion 1027 is inserted into the limiting curved groove 1017. Furthermore, a first insertion member 1051 and a second insertion member 10S2 are formed on the top surface of the second circular plate 1021. The first insertion member 1051 is located between the fourth curved slot 1024 and the assembly hole 1023 while the second insertion member 10S2 is located between the second curved slot 1025 and the assembly hole 1023. The first insertion member 1051 and the second insertion member 10S2 are arranged opposite to each other and respectively inserted into the third curved slot 1014 and the first curved slot 1015 when the second adjusting unit 102 is connected to the first adjusting unit 101.

The number of the snapping member (10C) is not limited and so is the number of the insertion member (10S). The number of the snapping member (10C) is not necessary the same as the number of the connection surface (10P). For example, there can be two snapping members (10C1, 10C2) engaged with the same connection surface (10P).

Figure 10:
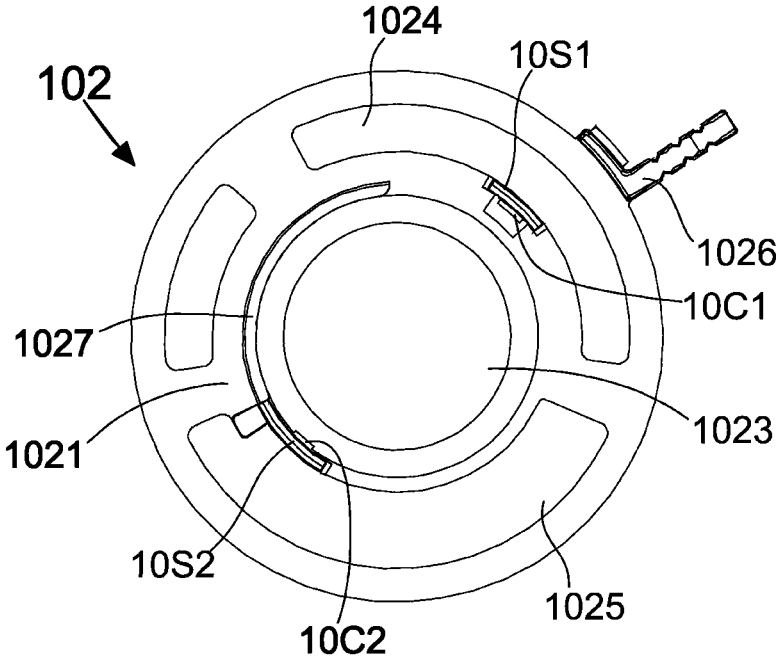
FIG. 10 is a front view of a second adjusting unit illustrating an embodiment of an oscillating range adjusting module according to the present invention.
Figure 12:
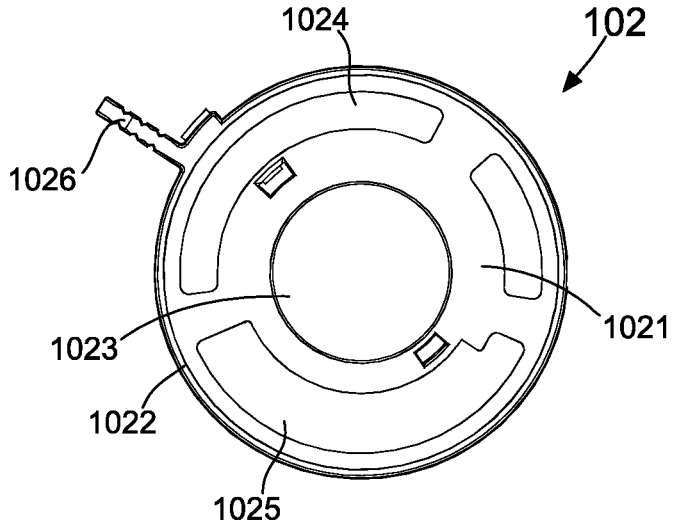
FIG. 12 is a rear view of a second adjusting unit illustrating an embodiment of an oscillating range adjusting module according to the present invention.
Figure 13:
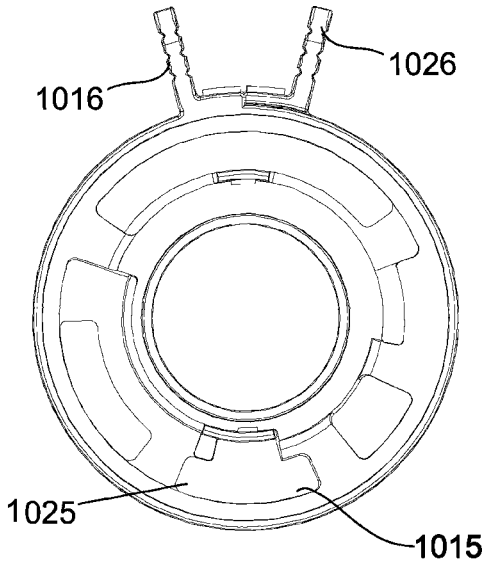
FIG. 13 illustrates a front view of an embodiment of an oscillating range adjusting module according to the present invention.
Figure 14:
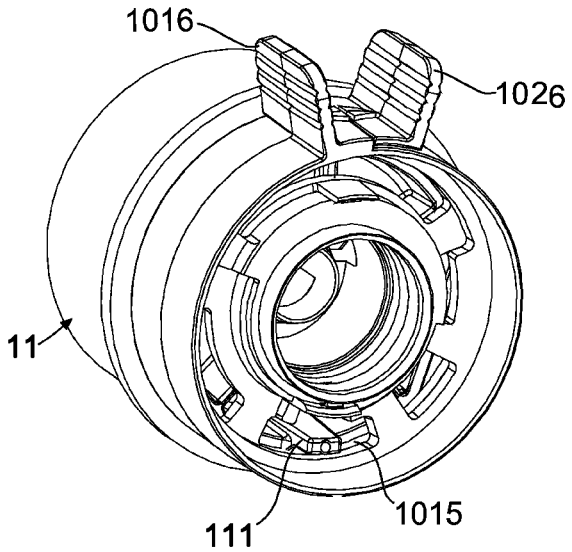
FIG. 14 is a perspective view of an assembly illustrating an embodiment of an oscillating range adjusting module with an oscillation driving module according to the present invention.

How the oscillating range adjusting module 10 of the present invention works is described in detail below with reference to FIGS. 9-16. FIG. 9 and FIG. 10 are respectively a front view of the first adjusting unit 101 and a front view of the second adjusting unit 102. FIG. 11 and FIG. 12 are respectively a rear view of the first adjusting unit 101 and a rear view of the second adjusting unit 102. FIG. 13 shows a front view of the oscillating range adjusting module 10 and so does FIG. 15. FIG. 14 is a perspective view of an assembly of the oscillating range adjusting module 10 with an oscillation driving module 11 and so is FIG. 16. FIGS. 13-16 are mainly used for showing interaction between the first adjusting unit 101 and the second the second adjusting unit 102 and the related numeric symbols can refer to FIG. 7-12.

As shown in FIG. 4, FIG. 13 and FIG. 14, users can adjust an oscillating range of the spraying nozzle module 13 by pulling the first pull member 1016 and/or the second pull member 1026. The oscillation of the spraying nozzle module 13 is controlled by the oscillation driving module 11. Referring to FIG. 13, an intersection of the first curved slot 1015 on the first circular plate 1011 and the second curved slot 1025 on the second circular plate 1021 forms a first limiting slot when the first base portion 11B of the first pull member 1016 is in contact with the second base portion 12B of the second pull member 1026. Thus a swing limiting member 111 of the oscillation driving module 11 can be limited to swing in the first limiting slot while the oscillation driving module 11 controlling the swing of the spraying nozzle module 13. As shown in FIG. 13 and FIG. 14, the first limiting slot is used for limiting the spraying nozzle module 13 to swing within a minimum oscillating range.

Figure 15:
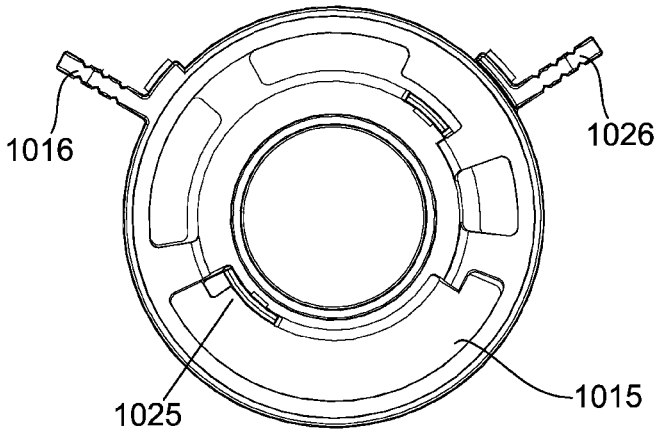
FIG. 15 illustrates a front view of an embodiment of an oscillating range adjusting module according to the present invention.
Figure 16:
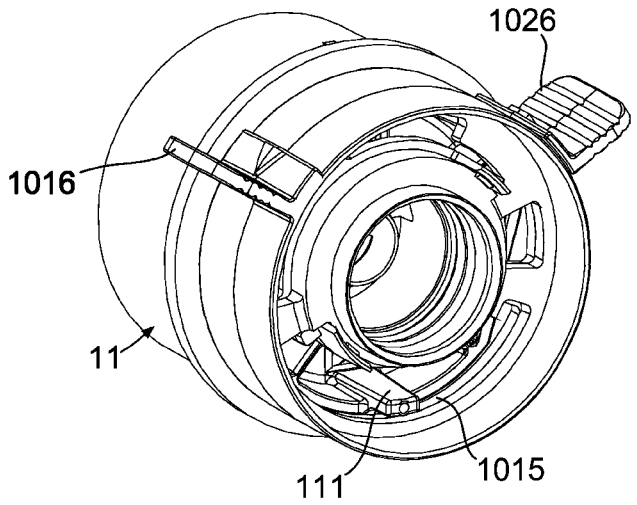
FIG. 16 is a perspective view of an assembly illustrating an embodiment of an oscillating range adjusting module with an oscillation driving module according to the present invention.

Referring to FIG. 4, FIG. 15 and FIG. 16, in order to change the oscillating range for the spraying nozzle module 13, users can set the maximum distance between the first pull member 1016 and the second pull member 1026 by pulling the first pull member 1016 and/or the second pull member 1026. At the moment, an intersection of the first curved slot 1015 on the first circular plate 1011 and the second curved slot 1025 on the second circular plate 1021 forms a second limiting slot. Thus a swing limiting member 111 of the oscillation driving module 11 can be limited to swing in the second limiting slot while the oscillation driving module 11 controlling the swing of the spraying nozzle module 13. As shown in FIG. 15 and FIG. 16, the second limiting slot is used for limiting the spraying nozzle module 13 to swing within a maximum oscillating range.

In summary, the oscillating range adjusting module 10 according to the present invention has the following advantages:

An oscillating range adjusting module 10 which comprises a first adjusting unit 101 and a second adjusting unit 102 can be assembled into a sprinkler 1 easily due to its modular design. The oscillating range adjusting module 10 is disposed between an oscillation driving module 11 and a water-in control module 12 in the sprinkler 1. While being assembled, firstly the first adjusting unit 101 is fitted on an inlet tube of the water-in control module 12 and then the O-ring 103 is connected to the first adjusting unit 101. Next the second adjusting unit 102 is mounted on the inlet tube and connected to the first adjusting unit 101 by the first and the second snapping members 10C1, 10C2 of the second adjusting unit 102 being engaged with the first and the second connection surfaces 10P1, 10P2 of the first adjusting unit 101. Lastly a water inlet of the oscillation driving module 11 is connected to the second adjusting unit 102. As a result, a modular assembly of the oscillating range adjusting module 10 between the oscillation driving module 11 and the water-in control module 12 is achieved.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An oscillating range adjusting module of a sprinkler, adapted to be connected between a water-in control module and an oscillation driving module of the sprinkler, wherein an oscillation of a spraying nozzle module of the sprinkler is controlled by the oscillation driving module, the oscillating range adjusting module comprising:

a first adjusting unit comprising a first circular plate, a first circular side wall formed on a top surface of the first circular plate and a hollow connecting cylinder formed on a center of the first circular plate, wherein the first circular plate consisting of a first curved slot and a third curved slot provided therein, wherein the first curved slot is located beside the hollow connecting cylinder and close to the first circular side wall and the third curved slot is located beside the hollow connecting cylinder and close to the first circular side wall, wherein on an edge at a bottom of hollow connecting cylinder, a first connection surface is formed an located between the third curved slot and the hollow connecting cylinder and a second connection surface is formed and located between the first curved slot and the hollow connecting cylinder, wherein a limiting curved groove is formed on a bottom surface of the first circular plate, wherein a first pull member is connected to an outer surface of the first circular side wall and located beside the hollow connecting cylinder and opposite to the first curved slot; and a second adjusting unit, configured to be connected to the first adjusting unit, comprising a second circular plate, a second circular side wall formed on a bottom surface of the second circular plate, a first insertion member, and a second insertion member, and having an assembly hole formed on a center of the second circular plate to be connected to the bottom of the hollow connecting cylinder of the first adjusting unit for forming a water inlet of the oscillation driving module of the sprinkler, wherein a first surface of the first circular plate, wherein the second circular plate consisting of a second curved slot and a fourth curved slot disposed thereon, wherein the second curved slot is located beside the assembly hole and close to the second circular side wall and the fourth curved slot is located beside the assembly hole and close to the second circular side wall, wherein the second circular plate further comprises a first snapping member and a second snapping member arranged at a top surface thereof and respectively engaged with the first connection surface and the second connection surface so as to connect the second adjusting unit to the first adjusting unit, wherein a limiting curved protrusion is formed on the top surface of the second circular plate to be mounted into the limiting curved groove of the first circular plate, wherein the first insertion member is formed on the top surface of the second circular plate and located between the fourth curved slot and the assembly hole and the second insertion member is formed on the top surface of the second circular plate and located between the second curved slot and the assembly hole, wherein the first insertion member and the second insertion member are arranged opposite to each other and respectfully inserted into the third curved slot and the first curved slot of the first adjusting unit when the second adjusting unit is connected to the first adjusting unit, wherein a second pull member is connected to an outer surface of the second circular side wall and located beside the assembly hole and opposite the second curved slot;

thereby when the first pull member is in contact with the second pull member, an intersection of the first curved slot of the first circular plate of the first adjusting unit and the second curved slot of the second circular plate of the second adjusting unit form a first limiting slot for limiting the spraying nozzle module to swing within a minimum oscillating range for limiting a swing limiting member of the oscillation driving module to swing in the first limiting slot, and that by pulling one of the first pull member and the second pull member to set a maximum distance therebetween, an intersection of the first curved slot of the first circular plate of the first adjusting unit and the second curved slot of the second circular plate of the second adjusting unit form a second limiting slot for limiting the spraying nozzle module to swing within a maximum oscillating range, so that a swing limiting member of the oscillation driving module of the sprinkler is able to be limited to swing in the second limiting slot while the oscillation driving module controlling a swing of the spraying nozzle module.

2. The oscillation range adjusting module, as recited in claim 1, further comprising an O-ring being clipped between the bottom of the hollow connecting cylinder of the first adjusting unit and an edge of the assembly hole of the second adjusting unit when the top surface of the second circular plate is connected to the bottom surface of the first circular plate and the limiting curved protrusion is inserted into the limiting curved groove.

3. The oscillating range adjusting module, as recited in claim 2, further comprising a first pull member connected to an outer surface of the first circular side wall and located beside the hollow connecting cylinder and opposite to the first curved slot, a second pull member connected to an outer surface of the second circular side wall and located beside the assembly hole and opposite to the second curved slot.

4. The oscillating range adjusting module, as recited in claim 3, wherein a surface of the first circular plate is defined as a top surface for facing a water-in control module of the sprinkler while a surface of the second circular plate is defined as a bottom surface for facing the oscillation driving module.

5. The oscillating range adjusting module, as recited in claim 4, wherein the first pull member comprises a first base portion and a first pull portion for being pulled while a bottom surface of the first base portion is in close contact with the outer surface of the second circular side wall, wherein the second pull member comprises a second base portion and a second pull portion for being pulled while a bottom surface of the second base portion is in close contact with the outer surface of the first circular side wall, wherein the first limiting slot is formed when the first base portion of the second pull member is in contact with the second base portion of the second pull member.

6. The oscillating range adjusting module, as recited in claim 3, wherein a surface of the second circular plate is defined as a top surface for facing a water-in control module of the sprinkler while a surface of the first circular plate is defined as a bottom surface for facing the oscillation driving module.

7. The oscillating range adjusting module, as recited in claim 6, wherein the first pull member comprises a first base portion and a first pull portion for being pulled while a bottom surface of the first base portion is in close contact with the outer surface of the second circular side wall, wherein the second pull member comprises a second base portion and a second pull portion for being pulled while a bottom surface of the second base portion is in close contact with the outer surface of the first circular side wall, wherein the first limiting slot is formed when the first base portion of the second pull member is in contact with the second base portion of the second pull member.

8. The oscillating range adjusting module, as recited in claim 3, wherein the first pull member comprises a first base portion and a first pull portion for being pulled while a bottom surface of the first base portion is in close contact with the outer surface of the second circular side wall, wherein the second pull member comprises a second base portion and a second pull portion for being pulled while a bottom surface of the second base portion is in close contact with the outer surface of the first circular side wall, wherein the first limiting slot is formed when the first base portion of the second pull member is in contact with the second base portion of the second pull member.

9. The oscillating range adjusting module, as recited in claim 2, wherein a surface of the first circular plate is defined as a top surface for facing a water-in control module of the sprinkler while a surface of the second circular plate is defined as a bottom surface for facing the oscillation driving module.

10. The oscillating range adjusting module, as recited in claim 2, wherein a surface of the second circular plate is defined as a top surface for facing a water-in control module of the sprinkler while a surface of the first circular plate is defined as a bottom surface for facing the oscillation driving module.

11. The oscillating range adjusting module, as recited in claim 1, further comprising a first pull member connected to an outer surface of the first circular side wall and located beside the hollow connecting cylinder and opposite to the first curved slot, a second pull member connected to an outer surface of the second circular side wall and located beside the assembly hole and opposite to the second curved slot.

12. The oscillating range adjusting module, as recited in claim 11, wherein a surface of the first circular plate is defined as a top surface for facing a water-in control module of the sprinkler while a surface of the second circular plate is defined as a bottom surface for facing the oscillation driving module.

13. The oscillating range adjusting module, as recited in claim 12, wherein the first pull member comprises a first base portion and a first pull portion for being pulled while a bottom surface of the first base portion is in close contact with the outer surface of the second circular side wall, wherein the second pull member comprises a second base portion and a second pull portion for being pulled while a bottom surface of the second base portion is in close contact with the outer surface of the first circular side wall, wherein the first limiting slot is formed when the first base portion of the second pull member is in contact with the second base portion of the second pull member.

14. The oscillating range adjusting module, as recited in claim 11, wherein a surface of the second circular plate is defined as a top surface for facing a water-in control module of the sprinkler while a surface of the first circular plate is defined as a bottom surface for facing the oscillation driving module.

15. The oscillating range adjusting module, as recited in claim 14, wherein the first pull member comprises a first base portion and a first pull portion for being pulled while a bottom surface of the first base portion is in close contact with the outer surface of the second circular side wall, wherein the second pull member comprises a second base portion and a second pull portion for being pulled while a bottom surface of the second base portion is in close contact with the outer surface of the first circular side wall, wherein the first limiting slot is formed when the first base portion of the second pull member is in contact with the second base portion of the second pull member.

16. The oscillating range adjusting module, as recited in claim 11, wherein the first pull member comprises a first base portion and a first pull portion for being pulled while a bottom surface of the first base portion is in close contact with the outer surface of the second circular side wall, wherein the second pull member comprises a second base portion and a second pull portion for being pulled while a bottom surface of the second base portion is in close contact with the outer surface of the first circular side wall, wherein the first limiting slot is formed when the first base portion of the second pull member is in contact with the second base portion of the second pull member.

17. The oscillating range adjusting module, as recited in claim 1, wherein a surface of the first circular plate is defined as a top surface for facing a water-in control module of the sprinkler while a surface of the second circular plate is defined as a bottom surface for facing the oscillation driving module.

18. The oscillating range adjusting module, as recited in claim 1, wherein a surface of the second circular plate is defined as a top surface for facing a water-in control module of the sprinkler while a surface of the first circular plate is defined as a bottom surface for facing the oscillation driving module.

* * * * *